US010252846B2

(12) United States Patent
Liu et al.

(10) Patent No.: US 10,252,846 B2
(45) Date of Patent: Apr. 9, 2019

(54) PACKAGE BOX

(71) Applicants: HONGFUJIN PRECISION ELECTRONICS (ZHENGZHOU) CO., LTD., Zhengzhou (CN); HON HAI PRECISION INDUSTRY CO., LTD., New Taipei (TW)

(72) Inventors: Yu-Ching Liu, New Taipei (TW); Xi-Hang Li, Shenzhen (CN); Er-Wei Chen, Shenzhen (CN); Bing Liu, Shenzhen (CN); Dong-Ya Wang, Shenzhen (CN); Cui-Ling Li, Shenzhen (CN)

(73) Assignees: HONGFUJIN PRECISION ELECTRONICS (ZHENGZHOU) CO., LTD, Zhengzhou (CN); HON HAI PRECISION INDUSTRY CO., LTD., New Taipei (TW)

( * ) Notice: Subject to any disclaimer, the term of this patent is extended or adjusted under 35 U.S.C. 154(b) by 205 days.

(21) Appl. No.: 14/974,120

(22) Filed: Dec. 18, 2015

(65) Prior Publication Data

US 2017/0144815 A1 May 25, 2017

(30) Foreign Application Priority Data

Nov. 20, 2015 (CN) ..... 2015 1 0804995

(51) Int. Cl.

| | |
|---|---|
| ***B65D 65/38*** | (2006.01) |
| ***B65D 75/22*** | (2006.01) |
| ***B65D 75/36*** | (2006.01) |
| ***B65D 77/04*** | (2006.01) |
| ***B65D 81/02*** | (2006.01) |

(52) U.S. Cl.

CPC ..... *B65D 75/36* (2013.01); *B65D 65/38* (2013.01); *B65D 75/22* (2013.01); *B65D 77/0413* (2013.01); *B65D 81/022* (2013.01)

(58) Field of Classification Search

CPC .... B65D 65/38; B65D 77/0413; B65D 75/36; B65D 75/22; B65D 81/022

USPC ..... 206/591

See application file for complete search history.

(56) References Cited

U.S. PATENT DOCUMENTS

| | | | | |
|---|---|---|---|---|
| 5,927,501 A * | 7/1999 | Herbruck | B65D 85/32 206/521.8 |
| 5,954,203 A * | 9/1999 | Marconi | B65D 43/162 206/464 |
| 2006/0060493 A1* | 3/2006 | Marshall | B65D 75/24 206/521.1 |
| 2013/0037435 A1* | 2/2013 | St-Laurent | B65D 71/36 206/427 |

FOREIGN PATENT DOCUMENTS

| | | |
|---|---|---|
| TW | 378641 | 1/2000 |

* cited by examiner

*Primary Examiner* — Anthony D Stashick
*Assistant Examiner* — James M Van Buskirk
(74) *Attorney, Agent, or Firm* — ScienBiziP, P.C.

(57) ABSTRACT

A package box includes a substrate board and a plurality of projections. The projections are formed on the substrate board. The substrate board includes a first surface and a second surface. The first surface is opposite to the second surface. Each of the projections is formed when the first surface of the substrate board protrudes toward the second surface of the substrate board.

17 Claims, 5 Drawing Sheets

PACKAGE BOX

CROSS-REFERENCE TO RELATED APPLICATIONS

This application claims priority to Chinese Patent Application No. 201510804995.1 filed on Nov. 20, 2015, the contents of which are incorporated by reference herein.

FIELD

The subject matter herein generally relates to packaging technology, and more particularly, to a buffer packing material and a package box made of the buffer packing material.

BACKGROUND

Generally, products need to be securely packaged to avoid damage during the transportation process.

BRIEF DESCRIPTION OF THE DRAWINGS

Implementations of the present disclosure will now be described, by way of example only, with reference to the attached figures.

DETAILED DESCRIPTION

Figure 1:
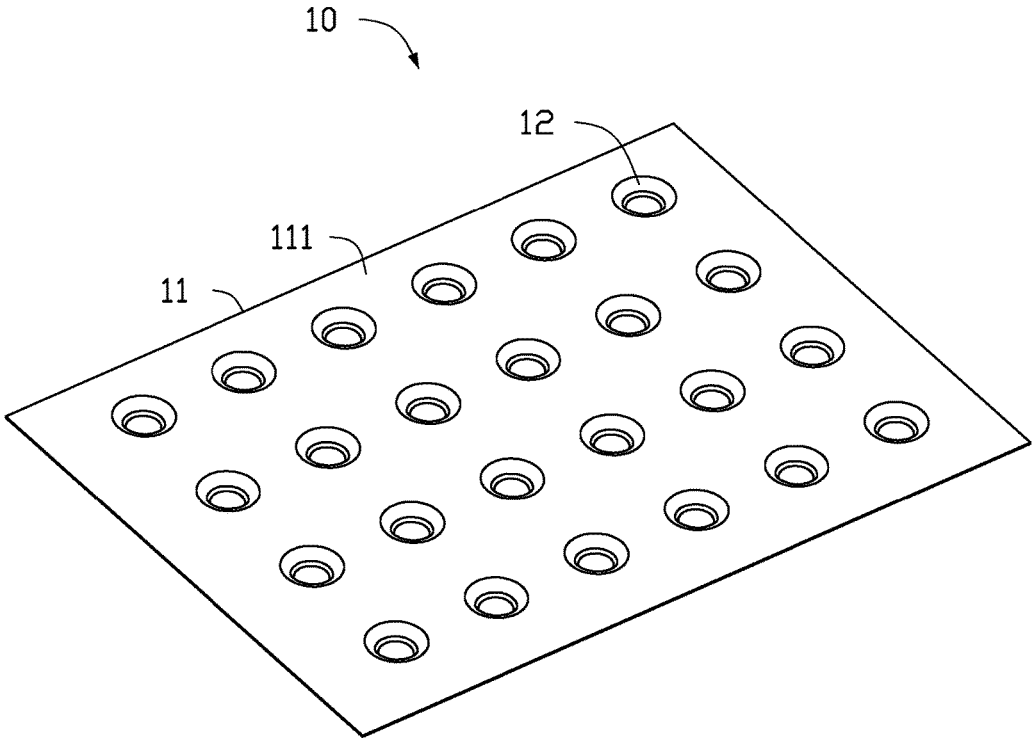
FIG. 1 is a diagrammatic view of one embodiment of a packing material.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features. The present disclosure, including the accompanying drawings, is illustrated by way of examples and not by way of limitation.

Several definitions that apply throughout this disclosure will now be presented.

References to "a/an" or "one" embodiment in this disclosure are not necessarily to the same embodiment, and such references mean "at least one." An embodiment refers to an example. The term "comprising" means "including, but not necessarily limited to"; it specifically indicates open-ended inclusion or membership in a so-described combination, group, series and the like.

Figure 2:
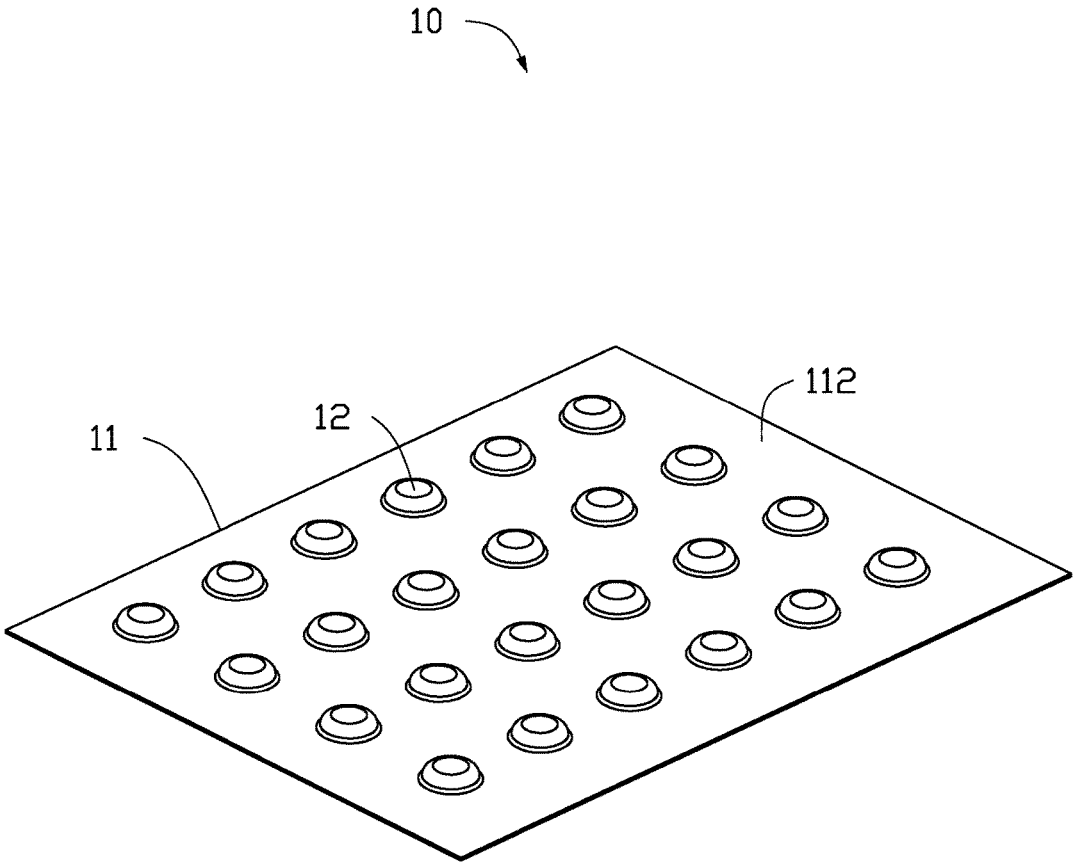
FIG. 2 is another diagrammatic view of the packing material as shown in FIG. 1.
Figure 3:
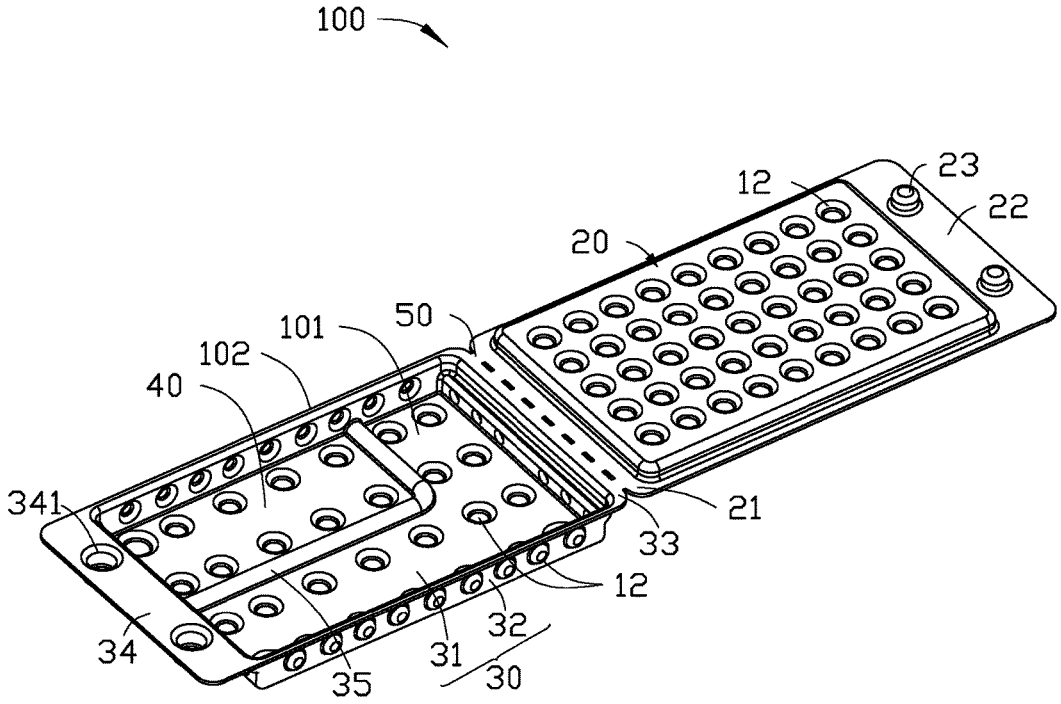
FIG. 3 is a diagrammatic view of one embodiment of a package box using the packing material as shown in FIG. 1.

FIG. 1 shows a diagrammatic view of packing material 10. FIG. 2 shows another diagrammatic view of the packing material 10 as shown in FIG. 1. The packing material 10 includes a substrate board 11. The substrate board 11 includes a first surface 111 and a second surface 112. The first surface 111 is opposite to the second surface 112. The first surface 111 is protruded toward the second surface 112 to form a number of projections 12. The projections 12 can be hollow. In at least one embodiment, the projections 12 can be a half sphere. In other embodiments, the projections 12 can be in other suitable shapes, for example, cylinder shaped, or cone shaped, or dome shaped. In at least one embodiment, the substrate board 11 can be made of paper pulp packaging materials, such as packaging paperboard. In order to facilitate for easy storage, the packing material 10 can be easily folded into a particular shape, the substrate board 11 can include a folded crease 50 (as shown in FIG. 3). In other embodiments, the substrate board 11 can be made of plastic foam materials, for example, expanded polystyrene. The projections 12 on the substrate board 11 can be orderly arranged in rows and columns.

Figure 4:
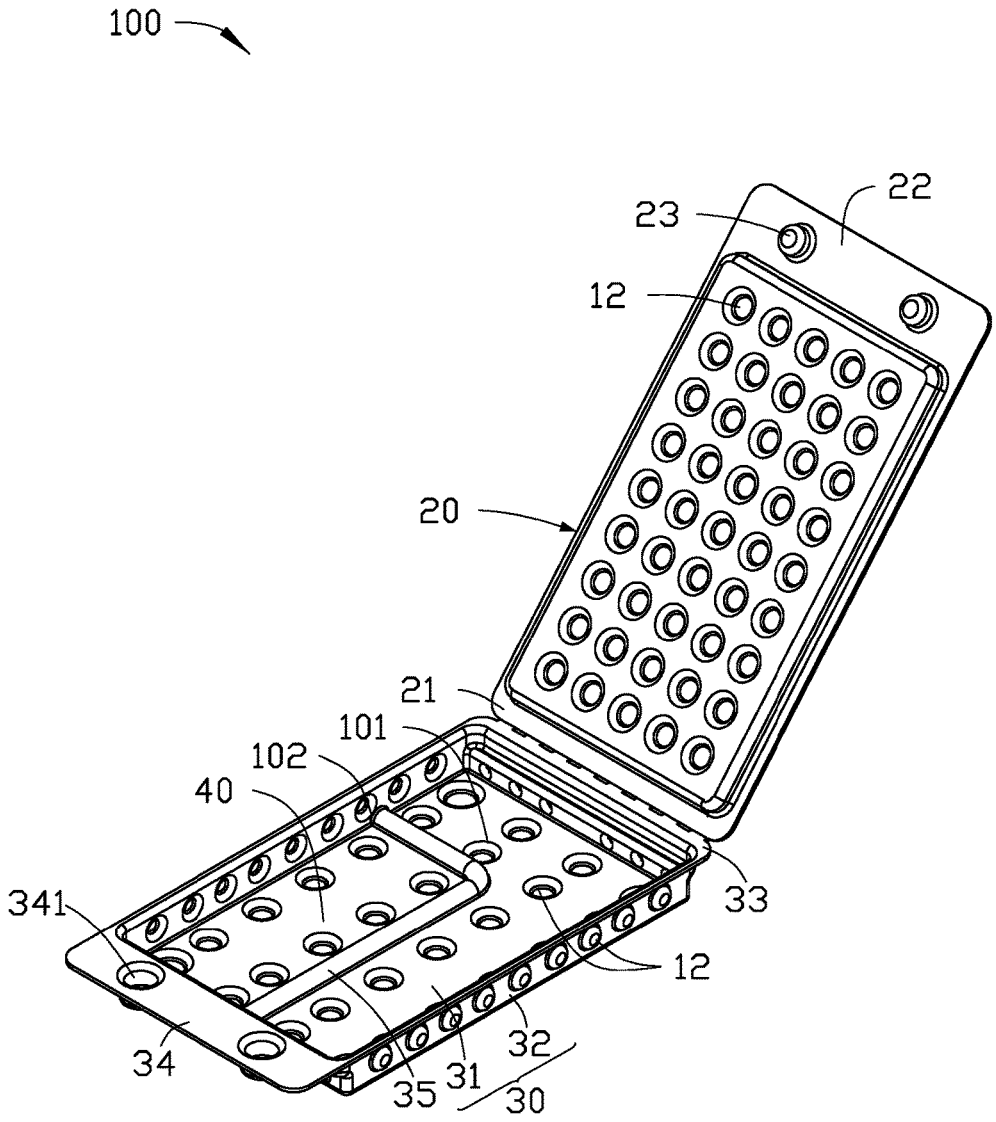
FIG. 4 is an isometric view of the package box as shown in FIG. 3 in a second state.
Figure 5:
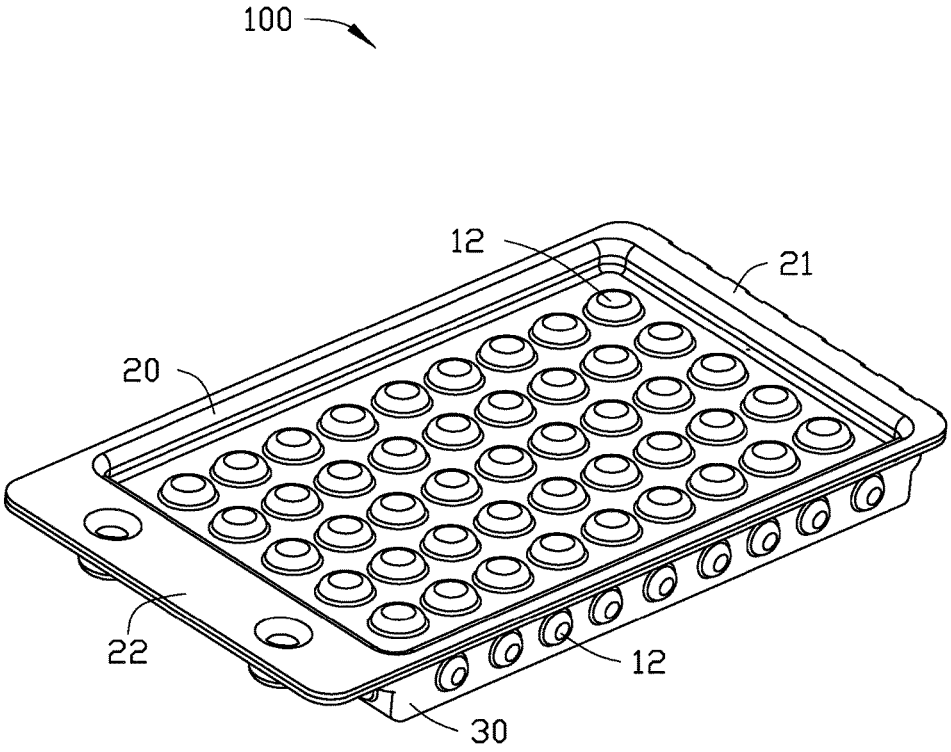
FIG. 5 is an isometric view of the package box as shown in FIG. 3 in a closed state.

FIG. 3 shows a diagrammatic view of a package box 100. The package box 100 can be made of the packing material 10. FIG. 4 shows an isometric view of the package box 100 in a second state. FIG. 5 shows an isometric view of the package box 100 in a closed state. The package box 100 includes a cover 20 and a bottom case 30. The cover 20 and the bottom case 30 match each other.

The bottom case 30 includes a bottom board 31 and four side walls 32. The four side walls 32 are arranged surrounding the bottom board 31 to form a containing chamber 40. The bottom board 31 and the four side walls 32 are made of the packing material 10. The projections 12 includes second projections that are formed on the bottom board 31 and third projections that are formed on the side walls 32. Each of the projections 12 is formed by the internal surface 101 of the package box 100 protruding toward the outside surface 102 of the package box 100. That is, the first surface 111 of the substrate board 11 is constructed as the internal surface 101 of the package box 100; the second surface 112 of the substrate board 11 is constructed as the outside surface 102 of the package box 100. In at least one embodiment, the bottom case 30 is integrally molding made.

In at least one embodiment as shown in FIG. 3, the quantity and the arrangement of the projections 12 on the bottom case 30 are the same as that of the cover 20. In other embodiments, the quantity, the arrangement and the shape of the projections 12 on the bottom case 30 are different from that of the cover 20. In at least one embodiment, as shown in FIG. 3 and FIG. 5, a number of columns of the projections 12 formed on the cover 20 being equal to a number of columns of the projections 12 formed on at least one of the four side walls 32.

As shown in FIG. 3, two side walls 32 of the bottom case 30 are opposite to each other, the two side walls 32 of the bottom case 30 which are opposite to each other includes a first side wall and a second side wall, a first connection element 33 extends from the first side wall, and a second connection element 34 extends from the second side wall. The second connection element 34 defines at least one cavity 341. A first sub-connection element 21 is formed on the cover 20 and corresponds to the first connection element 33 of the bottom case 30. A second sub-connection element 22 is formed on the cover 20 and corresponds to the second connection element 34 of the bottom case 30. In the illustrated embodiment, as shown in FIG. 3, the second connection element 34 defines two cavities 341.

In the illustrated embodiment as shown in FIG. 3, the cover 20 and bottom case 30 are integrally molded. A folded crease 50 is formed between the first connection element 33 of the bottom case 30 and the first sub-connection element 21 of the cover 20. Then, the cover 20 can rotate at the folded crease 50 so as to open and close the package box 100.

At least one lug 23 is formed on the second sub-connection element 22 and corresponds to the at least one cavity 341 of the second connection element 34. The diameter of the at least one lug 23 matches that of the at least one cavity 341. The at least one lug 23 can be received into the at least one cavity 341 when the package box 100 in a closed state, thereby providing support buffer protection for an accommodated object in the containing chamber 40. In the illustrated embodiment, as shown in FIG. 3, two lugs 23 are formed on the second sub-connection element 34, the two lugs 23 correspond to the two cavities 341, and are respectively received into the two cavities 341 when the package box 100 is in the closed state.

When using the package box 100, an object is put into the containing chamber 40. The cover 20 is rotated at the folded crease 50 so that the cover 20 can cover the bottom case 30 and the at least one lug 23 can correspond to the at least one cavity 341. A force is added on the cover 20 to make the at least one lug 23 to be received into the at least one cavity 341, thus closing the package box 100. The object fully accommodated in the containing chamber 40 is wholly packed by the package box 100.

In other embodiments, a groove 35 is formed on the internal surface of the bottom board 31, and can be configured to receive accessories of the object, such as a power line.

In other embodiments, the cover 20 and the bottom case 30 of the package box 100 are respectively formed, that is, the first connection element 33 of the bottom case 30 is separated from the first sub-connection element 21 of cover 20. In the condition, in order to pack the accommodated object, the cover 20 and the bottom case 30 can be fixed together via fasteners. Similarly, the first connection element 33 and the first sub-connection element 21, the second connection element 34 and the second sub-connection element 22 can be fixed together via the fasteners.

The embodiments shown and described above are only examples. Even though numerous characteristics and advantages of the present technology have been set forth in the foregoing description, together with details of the structure and function of the present disclosure, the disclosure is illustrative only, and changes can be made in the detail, including in particular the matters of shape, size, and arrangement of parts within the principles of the present disclosure, up to and including the full extent established by the broad general meaning of the terms used in the claims.

What is claimed is:

1. A packing material comprising:

a substrate board comprising a first surface and a second surface opposite to the first surface; and a plurality of projections formed on the substrate board by the first surface protruding toward the second surface of the substrate board.

2. The packing material as claimed in claim 1, wherein the substrate board is made of paper pulp packaging materials.

3. The packing material as claimed in claim 2, wherein the substrate board is made of packaging paperboard.

4. The packing material as claimed in claim 1, wherein the projections are half sphere shaped or cylinder shaped, or cone shaped, or dome shaped.

5. The packing material as claimed in claim 4, wherein the projections are hollow.

6. The packing material as claimed in claim 1, wherein the projections on the substrate board are orderly arranged in rows and columns.

7. The packing material as claimed in claim 1, wherein the substrate board comprises folded creases.

8. A package box, comprising:

a cover and a bottom case that are matched to each other;

wherein the bottom case comprises a bottom board and four side walls, the four side walls are arranged to surround the bottom board to form a containing chamber;

wherein a plurality of projections are formed on the package box;

wherein the plurality of projections comprises projections that are formed on the cover, projections that are formed on the bottom board, and projections that are formed on the side walls;

wherein each of the projections is formed by an internal surface of the package box protruding toward an outside surface of the package box.

9. The package box as claimed in claim 8, wherein a quantity and an arrangement of the projections that are formed on the cover are same as or different from those of the projections that are formed on the bottom board.

10. The package box as claimed in claim 8, wherein the plurality of projections are half sphere shaped or cylinder shaped, or cone shaped, or dome shaped.

11. The package box as claimed in claim 10, wherein the projections are hollow.

12. The package box as claimed in claim 8, wherein the projections that are formed on the cover and the projections that are formed on the bottom board are orderly arranged in rows and columns.

13. The package box as claimed in claim 8, wherein a number of columns of the projections that are formed on the cover is equal to a number of columns of the projections formed on at least one of the four side walls.

14. The package box as claimed in claim 8, wherein the cover and the bottom case are integrally molded.

15. The package box as claimed in claim 8, wherein a groove is formed on an internal surface of the bottom board for receive accessories of an object contained by the containing chamber.

16. The package box as claimed in claim 8, further comprising a first connection element, and a second connection element, wherein the first connection element extends from a first side wall of the four side walls, the second connection element extends from a second side wall of the four side walls, the first side wall and the second side wall being opposite to each other; the second connection element defines at least one cavity, a first sub-connection element is formed on the cover and corresponds to the first connection element of the bottom case; a second sub-connection element is formed on the cover and corresponds to the second connection element of the bottom case; a folded crease is formed between the first connection element of the bottom case and the first sub-connection element of the cover, the cover to rotate at the folded crease enable to open and close the package box; at least one lug is formed on the second sub-connection element and corresponds to the at least one cavity of the second connection element; the at least one lug is received into the at least one cavity when the package box in a closed state.

17. The package box as claimed in claim 16, wherein the second connection element defines two cavities; two lugs are formed on the second sub-connection element, the two lugs corresponding to the two cavities, and the two lugs are respectively received into the two cavities when the package box is in a closed state.

* * * * *